US009018839B2

(12) United States Patent
Guerrieri

(10) Patent No.: US 9,018,839 B2
(45) Date of Patent: Apr. 28, 2015

(54) LED COOLING SYSTEM

(76) Inventor: Salvatore Guerrieri, New York, NY (US)

( * ) Notice: Subject to any disclaimer, the term of this patent is extended or adjusted under 35 U.S.C. 154(b) by 477 days.

(21) Appl. No.: 13/332,355

(22) Filed: Dec. 20, 2011

(65) Prior Publication Data

US 2012/0153830 A1 Jun. 21, 2012

Related U.S. Application Data

(60) Provisional application No. 61/459,784, filed on Dec. 20, 2010.

(51) Int. Cl.
*H01J 7/24* (2006.01)
*F21V 29/00* (2006.01)
*F21Y 101/02* (2006.01)

(52) U.S. Cl.
CPC ..... *F21V 29/407* (2013.01); *F21Y 2101/02* (2013.01)

(58) Field of Classification Search
CPC ..... H01J 61/52; H01J 61/523; H01J 61/56; H01J 7/24; H05B 33/00; H05B 33/02; F21V 29/00; F21V 29/002; F21V 29/20; F21V 29/22; F21V 29/2206; F21V 29/26
USPC ..... 315/117, 118, 112, 113, 32, 291, 307, 315/309; 362/362, 373, 294, 257, 800
See application file for complete search history.

(56) References Cited

U.S. PATENT DOCUMENTS

2004/0120156 A1* 6/2004 Ryan ..... 362/373
2009/0212707 A1* 8/2009 Stevn ..... 315/113

* cited by examiner

*Primary Examiner* — David H Vu

(57) ABSTRACT

An LED cooling system comprising of a Peltier cooler. The Peltier cooler comprising of a top cooling plate and bottom heating plate. The top cooling plate is capable of directly contacting an LED housing such that heat generated by an LED in the LED housing can be transferred from the LED housing by said Peltier cooler; A control circuit electrically connected to said Peltier cooler to control the amount of power is supplied to said Peltier cooler; said amount of power supplied to said Peltier cooler is determined by the temperature of said LED housing.

12 Claims, 6 Drawing Sheets

LED COOLING SYSTEM

CROSS-REFERENCE TO RELATED APPLICATIONS

This application relates to and claims priority rights from provisional application U.S. 61/459,784 filed on Dec. 20, 2010, the entire disclosures of which are hereby incorporated by reference herein.

BACKGROUND OF THE INVENTION

1. Field of the Invention

This invention relates to an apparatus for providing a cooling system for an LED lighting system.

2. Description of the Related Art

LEDs are rapidly becoming a popular source of lighting systems. Using LEDs provide numerous advantages over traditional light bulbs. For example, the size of the LED is dramatically smaller than a typical incandescent bulb, but the luminance of the LED can be just as strong or even greater.

Since an LED is a semiconductor device, the temperature of the junction point of the LED should be controlled to ensure that the LED will not burn out. In addition, controlling the temperature of the LED junction point will help to sustain maximum light, life and color consistency. Rapid fluctuations in the temperature can have undesirable effects in an LED lighting as the color and the luminance of light emitted by the LED will also vary greatly with the temperature fluctuations and will be noticed in a lighting fixture that uses LEDs. Thus, these systems utilize a cooling system to regulate the heat generated by the LED.

Typical cooling systems can involve the use of a heat sink and/or fan to cool the junction point. Another cooling system that can be used is a Peltier cooler. A Peltier cooler is an electrical device that works as a heat pump whereby heat is transferred from one side to the other when current is supplied to the cooler. The amount of current powering the Peltier cooler will have a linear relationship to the heat transferred. Through the use of two plates on opposite sides of the cooler, the Peltier cooler can transfer the heat from one plate to the other thereby creating a cooling surface area. Having a cooling surface area allows the LED system to be directly cooled by a proactive system instead of having a passive heat sink. Thus, the temperature at the junction can be directly controlled.

While the use of a Peltier cooler allows for greater control in cooling an LED system, there are several disadvantages. Peltier coolers have very low efficiency. They can consume more power than they transport. Thus, having a Peltier cooler operating all the time will use a lot of energy making the device less energy efficient. The Peltier cooler will also generate heat on the heating plate, which will need to be dealt with to avoid affecting the LED system. Another consideration in using the Peltier system is that the cooling effect can cause condensation to gather on the cooling plate if the Peltier cooler operates consistently after a long period of time. That condensation can affect the operation of a LED based lighting system.

SUMMARY OF THE INVENTION

The above objects of the invention and advantages are achieved by having a cooling system that has a control system to be able to regulate the operation of the cooling system. The cooling system will utilize a Peltier cooler that will have the cooling plate directly in contact with the LED housing so that the junction point will receive the maximum cooling effect. The Peltier cooler will be controlled by a control system that will monitor the temperature to determine how much current will be used to power the Peltier cooler, thereby controlling the cooling effect. The heating plate of the Peltier cooling will have a traditional passive heat sink.

DETAILED DESCRIPTION OF THE EMBODIMENTS

Figure 1:
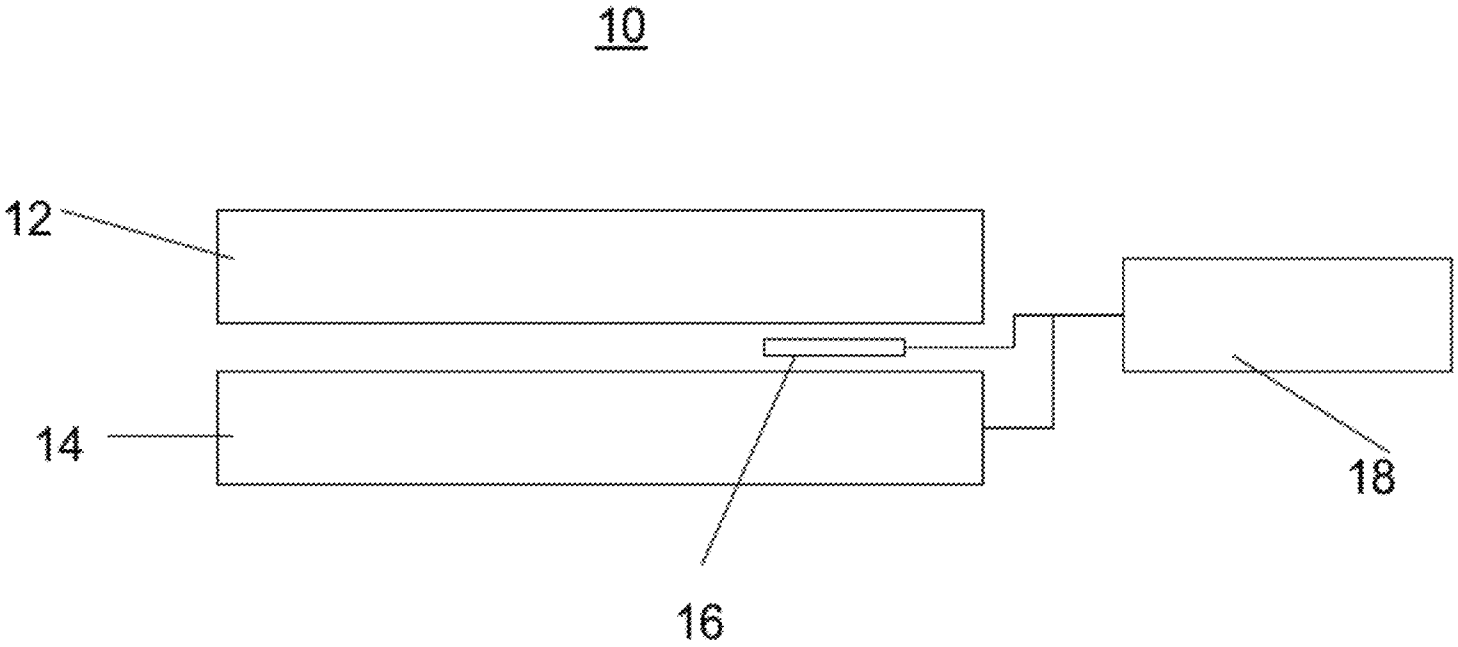
FIG. 1 depicts the components for one embodiment of the present invention.

For the purposes of understanding the invention, reference will now be made to the embodiments illustrated in the drawings. It will be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, one embodiment of the invented cooling system is depicted. LED lighting system 10 is composed of LED housing unit 12, cooling system 14, cooling control system 18 and temperature sensor 16. LED housing unit 12 will be directly in contact with the cooling system 14. Cooling control system 18 will be electrically connected with cooling system 14. Temperature sensor 16 will be electrically connected with cooling control system 18 and will be place in a location near to the LED housing unit 12 and cooling system 14. LED housing unit will be electrically connected to a separate control circuit and powered by separate electrical components that are not shown in FIG. 1, but will be known to one of skill in the art.

Figure 2:
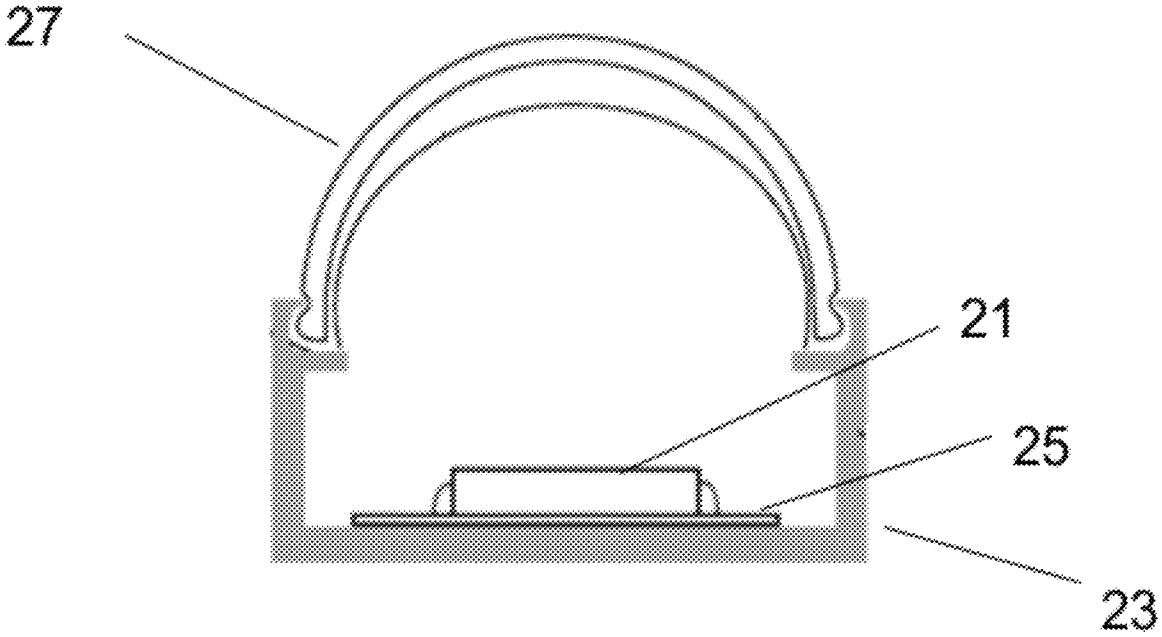
FIG. 2 depicts the components of the LED Housing Unit.

FIG. 2 depicts one embodiment of the LED housing. LED housing unit 12 is composed of LED 21, translucent lens 27, circuit board 25 and LED housing 23. Circuit board 25 can be electrically connected to and house other electrical components, such as other LEDs, electrical power contacts and/or electrical control components. Circuit board 25 will be powered by a power source (not shown). Circuit board is shown as a thin wafer strip, but it can be many different configurations and still be within the objections of the invention.

Translucent lens 27 will cover the LED 21 and aid in dispensing the light from the LED to a pleasing aesthetic effect. There is a space between the translucent lens 27 and LED 21, but that area can be filled with filling material that will be chosen to effect the color of the light being emitted from the LED. For example, a phosphorous filling can be used in combination with an blue light emitting LED to create a white color. The translucent lens and any filling can affect the heat transfer from the LED and/or the perception of the light emitted from the LED that could affect the design of the control circuit.

LED housing 23 will hold the circuit board and the LED itself. The LED housing will be directly in contact with the cooling system. The bottom of the LED housing is flat thereby increasing the surface area. The greater the surface area, the greater the cooling effect from being directly in contact with the cooling system. As such, the heat transfer properties of the housing can be chosen to aid in the cooling effect depending on the other elements being used. For example, if the circuit board houses many different LEDs or other electrical components that would generate more heat, a housing that is made of a material with a large heat transfer capacity might be desirable to aid in the cooling effect. The junction point which is important to regulate is in the vicinity of the circuit board containing the electrical components and the electrical connections.

Figure 3:
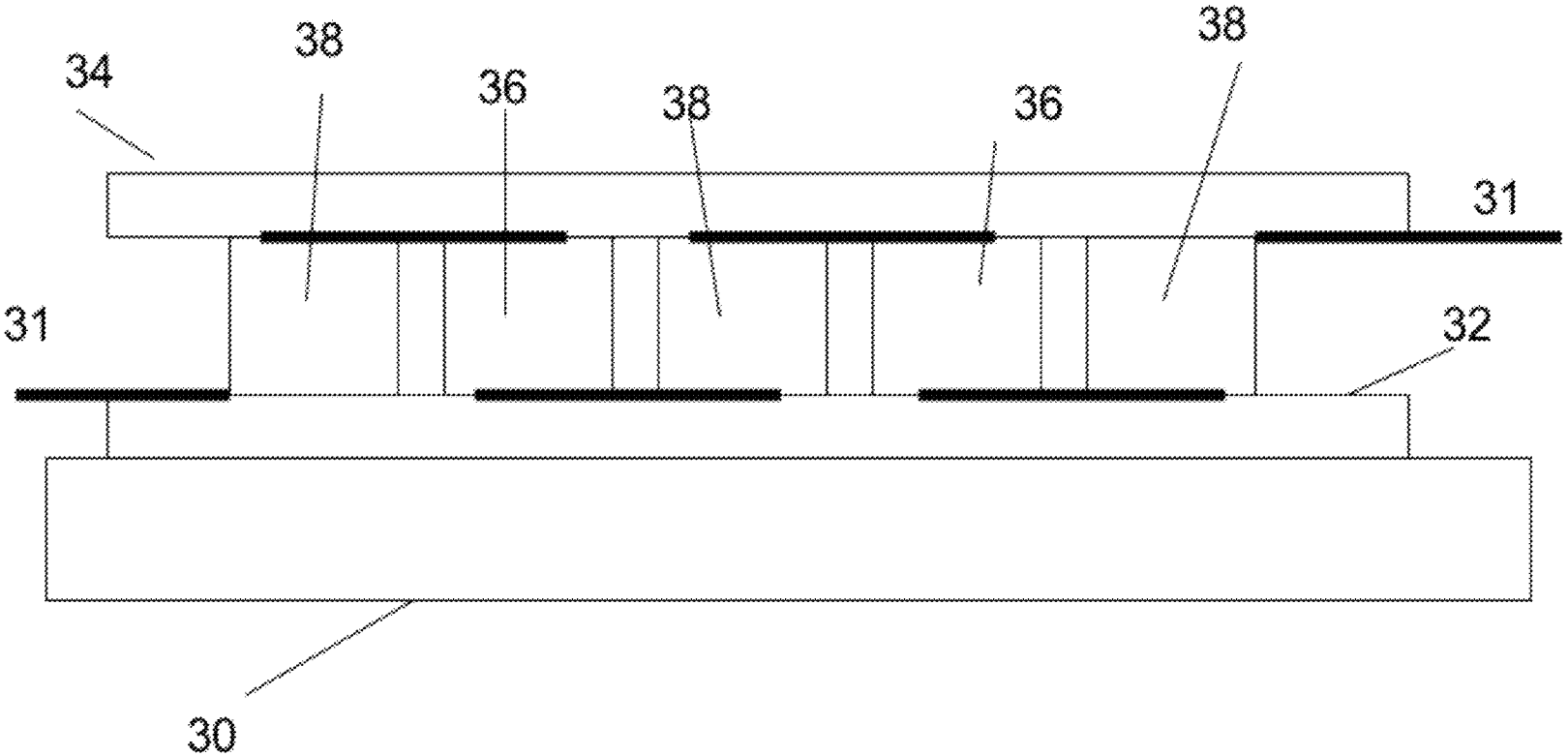
FIG. 3 depicts the components of the cooling system.

Cooling system 14 is depicted in FIG. 3 and is composed of a Peltier cooler. Top plate 34 is parallel to bottom plate 32. Several n-doped and p-doped areas 36 and 38 are located in between the bottom and top plates. These doped regions will be electrically connected to each other on opposing top and bottom sides. Top and bottom plates 34 and 32 should be made of material that is electrically insulated, but have very good thermal conductivity. Bottom plate will be connected to a heat sink made of a suitable material to dissipate the heat generated on bottom plate 32. The size of both the Peltier cooler and the appropriate heat sink will be chosen depending on the components of the LED housing and are well within the knowledge of one of ordinary skill in the art. Electrical leads 31 extend out of the Peltier cooler and will connect to control circuit 18.

Figure 4:
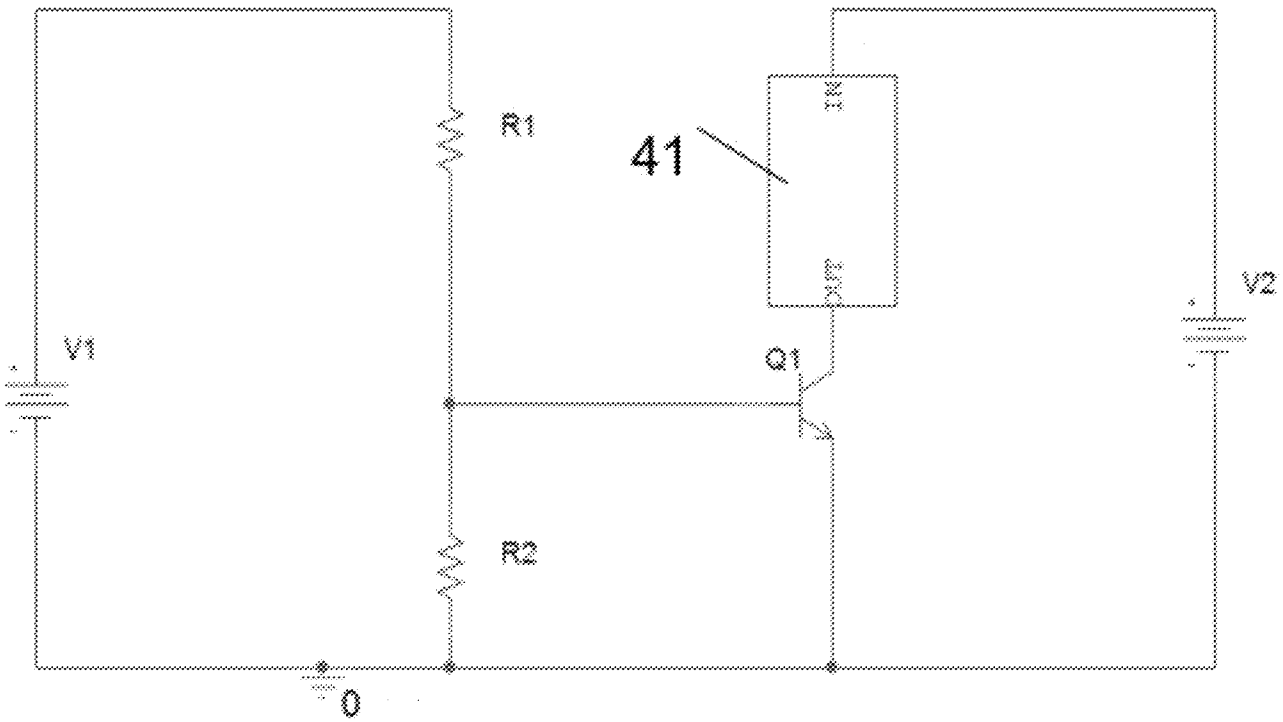
FIG. 4 depicts the components of the control system.
Figure 5:
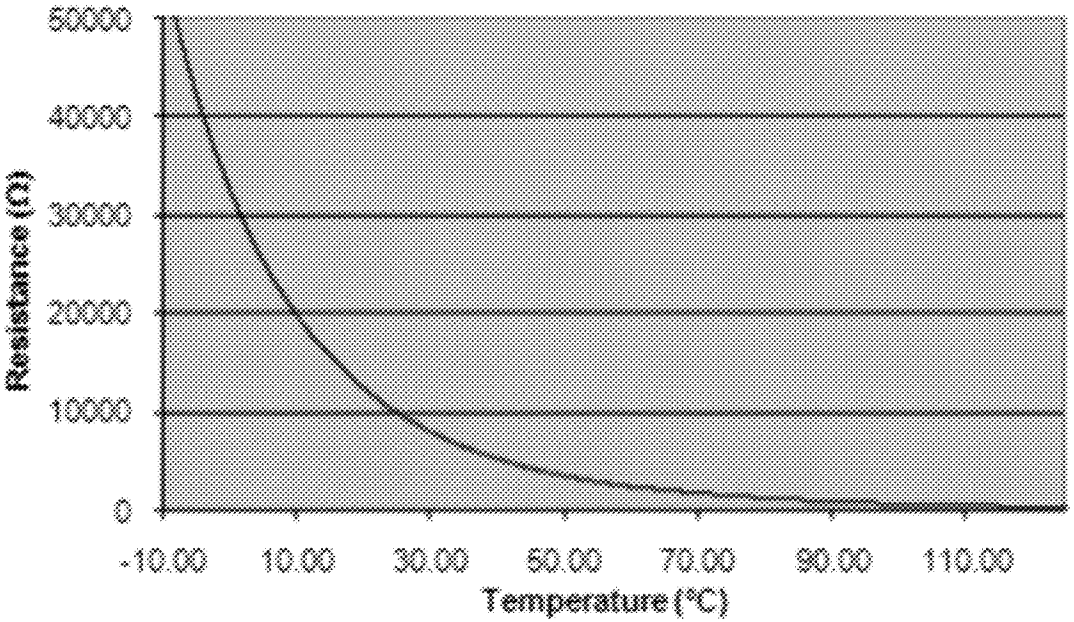
FIG. 5 depicts a graph showing exemplary operating characteristics of a thermistor.

One embodiment of control circuit 18 is depicted in FIG. 4. Control circuit is composed of a transistor Q1 whose collector is one of the connections to the Peltier cooler 41. The other input to the Peltier cooler is connected to a voltage source V2. The emitter of transistor Q1 is grounded and the base is connected to power source V1 through two resistors R1 and R2. R1 is a thermistor, which will have it resistance vary with the temperature of its sensor. The thermistor's temperature sensor is depicted in FIG. 1 as 16. A sample graph depicting the temperature resistance relationship is depicted as FIG. 5. Other electrical devices or systems can be used in place of thermistor that will have a more linear relationship between the temperature and resistance as long as the temperature of the sensor will vary the resistance in a known and controllable fashion.

In operation, the values of R2, V1 and V2 are chosen that transistor Q1 is off and no current is supplied to the cooling system 41. As the temperature of the LED housing increases (and the resistance of thermistor varies according to the temperature), the voltage at the base of the transistor becomes high enough to open transistor Q1 such that a beginning current is supplied to cooling system 41. If the temperature continues to increase, more current is supplied to cooling system 41 thereby increasing the cooling effect. At some time, the system either reaches an equilibrium point where the temperature remains constant or the Peltier cooler gets supplied the maximum current such that it is providing the maximum cooling effect.

The above operation of the cooling control circuit will depend greatly on the characteristics of the components used. The value of resistor R2 will mainly determine the temperature at which the transistor Q1 will initially turn on. The characteristics of transistor Q1 and thermistor R1 will greatly determine the speed at which the cooling system will receive current and thereby cool the LED housing. If the thermistor's temperature-resistance graph has a relatively flat curve at the operating temperatures, then the current supplied to the Peltier cooler will be smaller for each increase in temperature.

In deciding the components to use, the intended goal is to maintain the temperature at the junction point of the LED housing such that the light emitting from the LED does not vary greatly in luminance and color. In particular, the cooling control system is designed such that any variations in the temperature (and thus the color and luminance of the light) will be introduced gradually such that any light variations will occur slowly over a greater period of time. Rapid changes in the temperature will be more noticeable in the light fluctuations than changes in the temperature that are gradual. This consideration is unique to an LED cooling system whereby an important consideration for other semiconductor systems is maintaining an controlled ambient temperature rather than minimizing the temperature fluctuations. Even if the system stabilizes to a set ambient temperature, such a cooling system would not be desirable for an LED system where the light fluctuates as the temperature feedback causes the current to oscillate in the correction process.

As stated above, the value of resistor R2 and the specific thermistor/transistor used (with the desired temperature resistance relationship) will be chosen to determine when transistor Q1 will turn on and begin generating current to Peltier cooler 41. The value of R2 and the characteristics of the thermistor will also determine how much current is supplied to the Peltier cooler as the temperature changes and when enough current is supplied to the Peltier cooler 41 such that it is fully operational and has the maximum cooling effect. Factors that will be considered when determining the value of R2 and the thermistor could be (1) the sensitivity of the temperature on the emitting light of the LED, (2) the number of components on the circuit board, (3) the typical operating temperature of the LED, and (4) the heat transfer characteristics of the LED housing.

Each of the above factors will determine both the value of R2 and the specific type of thermistor chosen. For example, the sensitivity of the temperature on the emitting light of the LED is an important factor because it is highly desirable to have a stable light being emitted for any lighting fixture. If the color or luminance of the light emitted varied or oscillated, then the lighting fixture would be undesirable. In this case, if the LED were very sensitive to temperature in varying the light emitted, then the value of R2 and the specific thermistor could be chosen such that the cooling effect would gradually increase over a greater period of time rather than a quick cooling period. As such, R2 might be chosen such that the Peltier cooler will turn on at a lower temperature to begin an earlier starting period and a thermistor chosen that is more sensitive to temperature changes such that the current supplied to the Peltier cooler changes quickly in response to the temperature changes, but in smaller amounts so that the cooling effect is more gradual in time.

The factor of the amount of electrical components located on the circuit board will have the opposite effect. Since having more electrical components on the circuit board will generally create heat faster, the value of R2 and the characteristics of the thermistor chosen might be selected to ensure that a greater amount of cooling will occur as the temperature increases.

Figure 6:
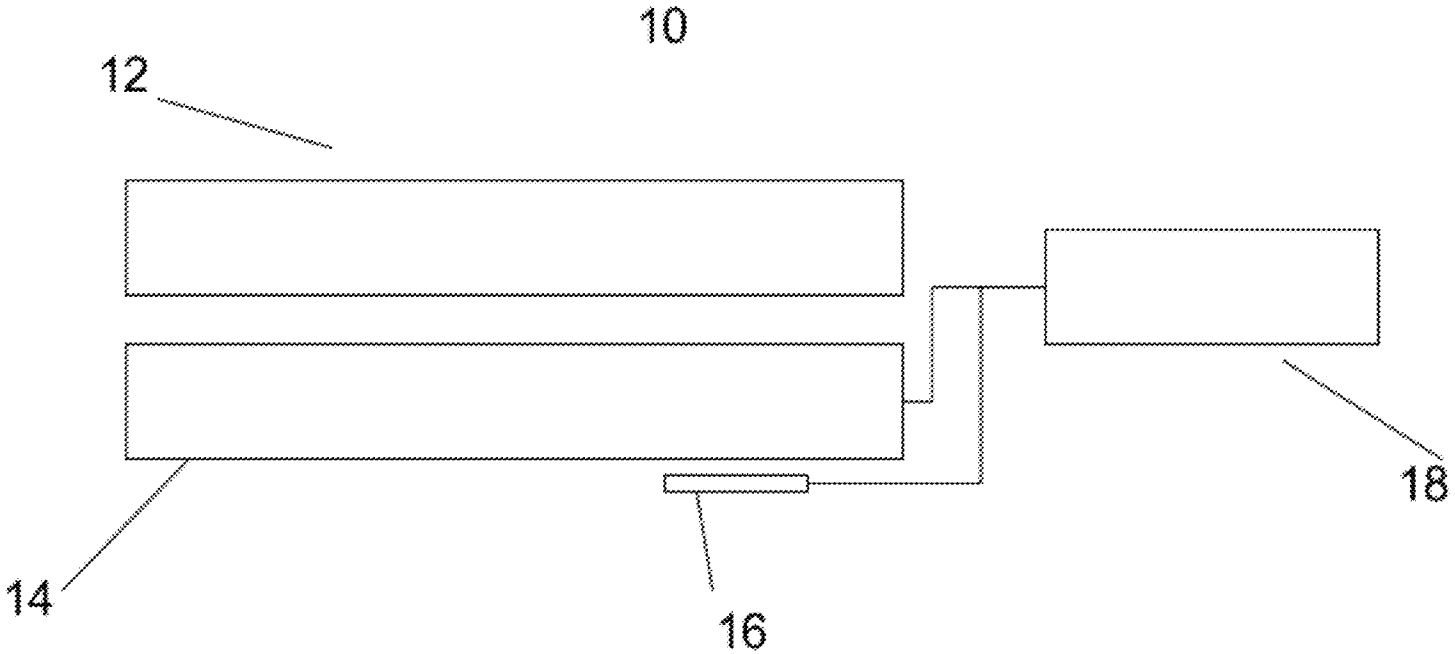
FIG. 6 depicts the components for a second embodiment of the present invention.

Along with the value of R2 and the temperature/resistance characteristics of the thermistor used, the location of the temperature sensor can also be varied to accommodate the above identified considerations. If the LED is very sensitive to temperature, then the location of the temperature sensor could be placed on the bottom of the cooling system instead of between the cooling system and the LED housing unit. If the temperature sensor were placed on the bottom of the cooling system, then the temperature sensor would be detecting the heat generated from the heating plate of the Peltier cooler as well as the heat from the LED circuitry. This is depicted in FIG. 6. This will result in a slower and more stable cooling effect, which would lead to less fluctuations in the light emission of the LED. It has been found that designing the control circuit such that the Peltier cooler will first be turn on around room temperature and will be fully turned on when the temperature is at the highest expected temperature to be reached results in a system that maintains the temperature of the LED with negligible light fluctuations.

What is claimed is:

1. An LED lighting system, comprising:

an LED housing holding an LED that will generate heat when it is emitting light;

a cooling system; said cooling system situated to be able to transfer heat from the LED and said LED housing; and a control circuit that will control the amount of heat that will be transferred from the LED and LED housing by said cooling system; wherein said control circuit will monitor the temperature of said LED housing and control the amount of heat being transferred from said LED housing by said cooling system based on the temperature of the LED housing; said control circuit comprising of a transistor, a thermistor and a resistance unit; the size of said resistance unit and the sensitivity of said thermistor determining the operational characteristics of said control circuit; the size of said resistance unit and the sensitivity of said thermistor being determined on the basis at least one of the factors of the group consisting of (1) the heat transfer characteristics of the LED housing, (2) the sensitivity of the temperature on the emitting light of the LED and (3) the number of components in the LED housing such that light fluctuations in the light emitted by said LED that is caused by the temperature variations in said LED housing is minimized.

2. The LED lighting system as recited in claim 1, wherein said cooling system is composed of a Peltier cooler; said Peltier cooler having a cooling plate and a heating plate.

3. The LED lighting system as recited in claim 2, wherein said LED housing contacts said cooling plate.

4. The LED lighting system as recited in claim 2, further comprising a heat sink contacting said heating plate.

5. The LED lighting system as recited in claim 1 further comprising a temperature sensor to monitor the temperature of the LED housing wherein the temperature sensor is located in between the cooling system and said LED housing.

6. The LED lighting device as recited in claim 5, wherein the temperature sensor contacts said heating plate.

7. The LED lighting system as recited in claim 1 wherein said control circuit will control the amount of heat being transferred from said LED housing by said cooling system such that the size of the temperature variations in said LED housing is reduced.

8. An LED cooling system comprising of a Peltier cooler, said Peltier cooler comprising of a top cooling plate and bottom heating plate;

said top cooling plate capable of directly contacting an LED housing such that heat generated by an LED in said LED housing can be transferred from said LED housing by said Peltier cooler;

a control circuit electrically connected to said Peltier cooler to control the amount of power is supplied to said Peltier cooler; said amount of power supplied to said Peltier cooler is determined by the temperature of said LED housing; said control circuit comprising of a transistor, a thermistor and a resistance unit; the size of said resistance unit and the sensitivity of said thermistor determining the operational characteristics of said control circuit; the size of said resistance unit and the sensitivity of said thermistor being determined on the basis at least one of the factors of the group consisting of (1) the heat transfer characteristics of the LED housing, (2) the sensitivity of the temperature on the emitting light of the LED and (3) the number of components in the LED housing such that light fluctuations in the light emitted by said LED that is caused by the temperature variations in said LED housing is minimized.

9. The LED cooling system as recited in claim 8, wherein said thermistor comprises a temperature sensor.

10. The LED cooling system as recited in claim 9 wherein said temperature sensor is located at the bottom heating plate of said Peltier cooler.

11. The LED cooling system as recited in claim 9 wherein said temperature sensor is located between said top cooling plate and the LED housing.

12. The LED cooling system as recited in claim 8 wherein said control circuit will begin to supply power to said Peltier cooler when the temperature of the LED housing is at room temperature.

* * * * *